US007793577B2

(12) United States Patent
Garwood

(10) Patent No.: US 7,793,577 B2
(45) Date of Patent: Sep. 14, 2010

(54) RETROFIT COOLING SYSTEM FOR GATLING MACHINE GUN

(76) Inventor: Tracy W. Garwood, 13401 N. 76th Pl., Scottsdale, AZ (US) 85260

( * ) Notice: Subject to any disclaimer, the term of this patent is extended or adjusted under 35 U.S.C. 154(b) by 386 days.

(21) Appl. No.: 11/825,025

(22) Filed: Jul. 3, 2007

(65) Prior Publication Data

US 2010/0192759 A1 Aug. 5, 2010

(51) Int. Cl.
*F41F 1/10* (2006.01)

(52) U.S. Cl. ..... 89/12; 89/1.41

(58) Field of Classification Search ..... 89/1.41, 89/12, 14.1, 126
See application file for complete search history.

(56) References Cited

U.S. PATENT DOCUMENTS 1,328,230 A * 1/1920 Johnston ..... 89/12
1,337,971 A * 4/1920 Watkins ..... 89/13.05
1,351,017 A * 8/1920 Blackmore ..... 89/126
1,434,812 A * 11/1922 Fowler ..... 89/199
1,527,585 A * 2/1925 Laurens et al. ..... 89/14.1
1,543,262 A * 6/1925 Methlin ..... 89/14.1
1,631,190 A * 6/1927 Bull ..... 89/14.1
2,205,426 A * 6/1940 Lochhead ..... 89/14.1
2,388,807 A * 11/1945 Stephenson ..... 89/14.1
2,801,575 A * 8/1957 Grover ..... 89/155
2,859,664 A * 11/1958 Murphy ..... 89/155
2,972,286 A * 2/1961 Marquardt ..... 89/126
3,613,655 A * 10/1971 Tobin et al. ..... 124/6
4,062,266 A * 12/1977 Elmore et al. ..... 89/7
4,535,676 A * 8/1985 Politzer et al. ..... 89/14.1
4,656,919 A * 4/1987 Farinacci et al. ..... 89/14.6
2005/0262996 A1* 12/2005 O'Dwyer ..... 89/12

* cited by examiner

*Primary Examiner*—Bret Hayes
(74) *Attorney, Agent, or Firm*—Tod R. Nissle, P.C.

(57) ABSTRACT

A cooling system for a Gatling machine gun can be use to retrofit an existing machine gun or can be incorporated in a newly manufactured gun. The system directs fluid through the housing assembly of the machine gun to a location intermediate barrels of the gun, and discharges the fluid to cool the barrels.

1 Claim, 5 Drawing Sheets

FIG. 1: Prior Art

FIG. 2: *Prior Art*

RETROFIT COOLING SYSTEM FOR GATLING MACHINE GUN

This invention relates to Gatling machine guns.

More particularly, the invention relates to a system for cooling a Gatling machine gun. A Gatling gun is a gun that has multiple barrels circumferentially mounted to be utilized sequentially to fire ammunition through the barrels.

One factor limiting the use of a Gatling gun is the heat the gun produces while being fired. The heat is substantial and, in order to prevent damage to the gun, requires that the gun be operated intermittently for relatively short periods of time. This is a problem because an individual firing a Gatling gun, particularly in combat, tends to fire the gun continuously for overlong periods of time, rendering the gun inoperable.

Therefore, it would be highly desirable to provide an improved method and apparatus to cool a Gatling gun to reduce the risk that the gun will be damaged during use.

Accordingly, it is a principal object of the invention to provide an improved method and apparatus to cool a Gatling gun to extend the period of time during which the gun can be fired without damaging the gun.

A further method of the invention is to provide an improved method and apparatus for retrofitting a Gatling gun with an improved cooling system.

These and other, further and more specific objects and advantages of the invention will be apparent to those of skill in the art from the following detailed description thereof, taken in conjunction with the drawings, in which.

Briefly, in accordance with the invention, I provide improvements for a machine gun. The machine gun includes a rotatable barrel assembly that includes a plurality of circumferentially mounted barrels. The improvements comprise a cooling system comprising at least one fluid conduit having a perforated end extending intermediate the circumferentially mounted barrels; and, a system for directing a cooling fluid through the conduit and out the perforated conduit end intermediate the circumferentially mounted barrels.

In another embodiment of the invention, I provide a kit for retrofitting a machine gun. The machine gun includes a rotatable barrel assembly that has a plurality of circumferentially mounted barrels. The kit comprises a fluid conduit having a perforated end and shaped and dimensioned to be mounted on the machine gun such that the perforated end extends intermediate the circumferentially mounted barrels.

In a further embodiment of the invention, I provide a control box assembly for a machine gun. The machine gun includes a rotatable barrel assembly that has a plurality of circumferentially mounted barrels. The machine gun control box comprises a housing; a firing control mounted in the housing; a control system for determining the temperature of the barrel assembly and, when the temperature reaches a selected level, for directing a cooling fluid against the barrel assembly.

Figure 1:
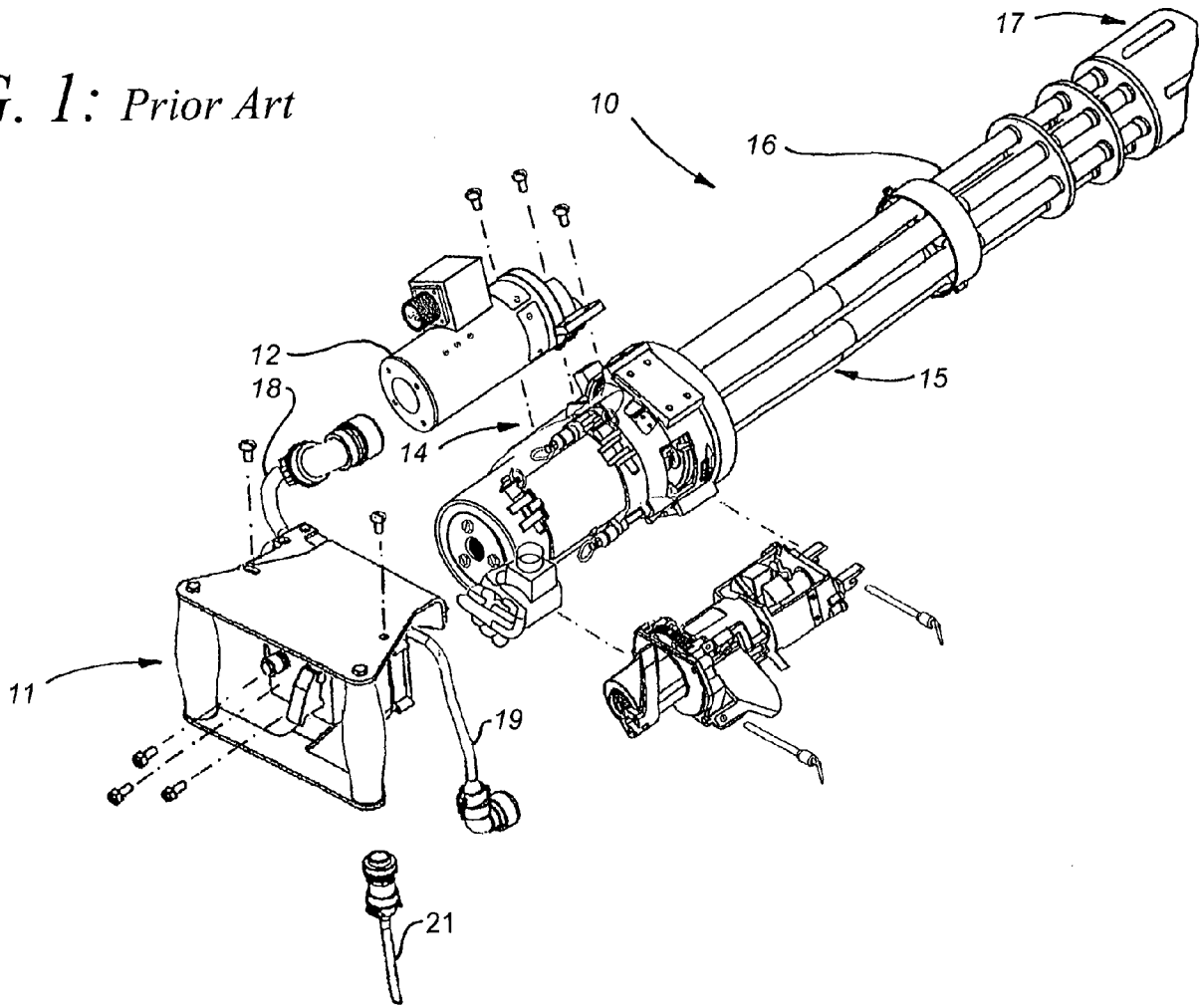
FIG. 1 is an exploded perspective view illustrating a Gatling gun known as a 7.62 minigun.
Figure 2:
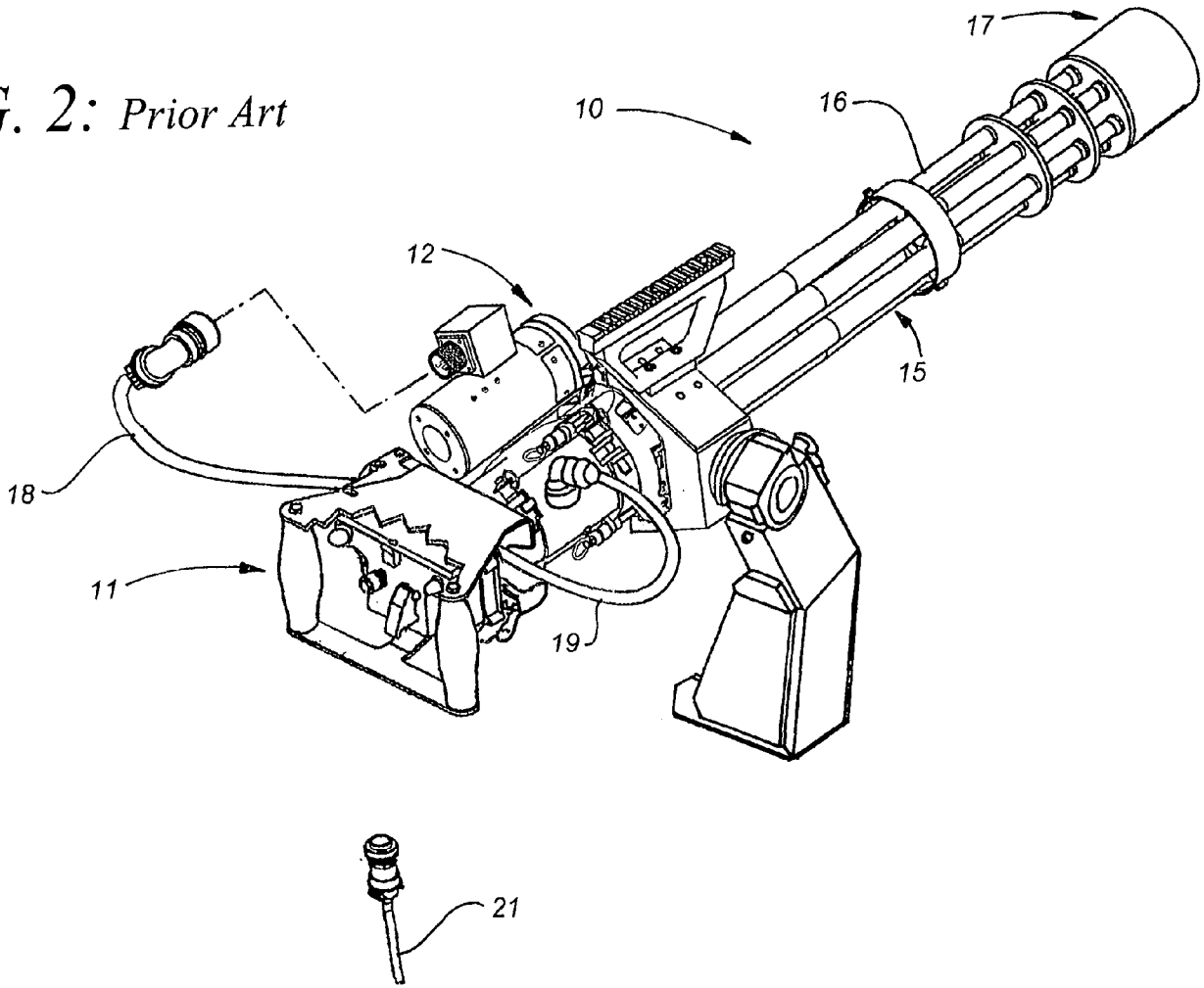
FIG. 2 is a perspective view illustrating the Gatling gun of FIG. 1 assembled.
Figure 3:
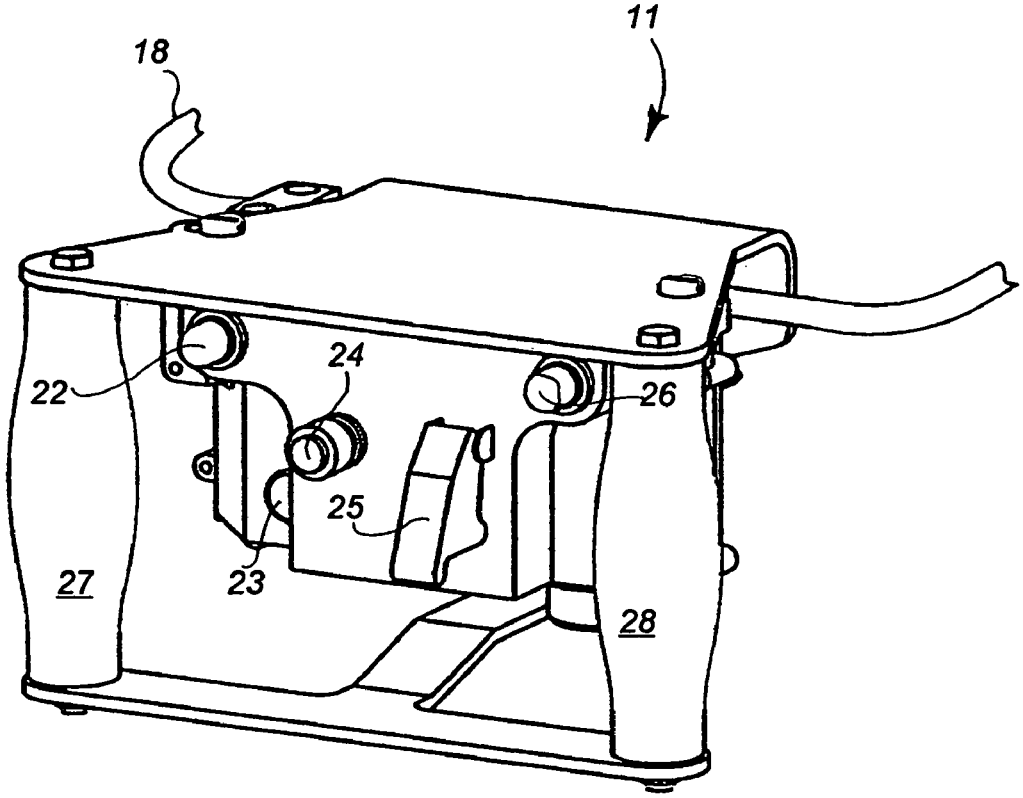
FIG. 3 (Prior Art)
FIG. 3 is a perspective view illustrating the control box of the Gatling gun of FIGS. 1 and 2.

Turning now the drawings, which depict the presently preferred embodiments of the invention for the purpose of illustration thereof, and not by way of limitation of the invention, and in which like characters refer to corresponding elements throughout the several views, FIGS. 1 to 3 illustrate a 7.62 "minigun" Gatling gun generally identified by reference character 10. Gun 10 includes barrel assembly 15, motor 12, feeder/delinker 20, clutch assembly 13, gun housing assembly 14, and control box 11. Barrel assembly 15 includes a plurality of circumferentially mounted barrels 16 and a flash suppressor 17. Ammunition is fired sequentially through barrels 16 in well known fashion, i.e., first one barrel is used, then the next, then the next, etc. Cable 21 supplies power to the control box 11. Cable 18 supplies power from the control box 11 to motor 12. The feeder/delinker is engaged and disengaged by cable 19.

As is illustrated in FIG. 3, control box 11 includes depressible firing buttons 22 and 26, booster motor override control button 23, safety cover 25 over an arming switch (not visible), arming indicator light 24, and handles 27 and 28. When the arming switch is activated, light 24 illuminates, and when either one or both of the firing buttons 22, 26 are then depressed, the gun will fire. When the firing switch(es) is released, the feeder/delinker 20 (ammunition feed device) is disengaged so the ammunition supply is discontinued. The electric motor 12 continues to rotate for about 200 to 400 milliseconds so that the weapon is cleared of remaining ammunition before stopping. The booster motor override control button 23, when depressed, activates the ammunition booster motor on the ammunition magazine (not shown) to facilitate the loading of the weapon. The booster motor pushes the belted ammunition from the ammunition magazine, through the feed chute, and to the weapon where it is inserted in the feeder/delinker 20, readying the weapon for firing.

Figure 4:
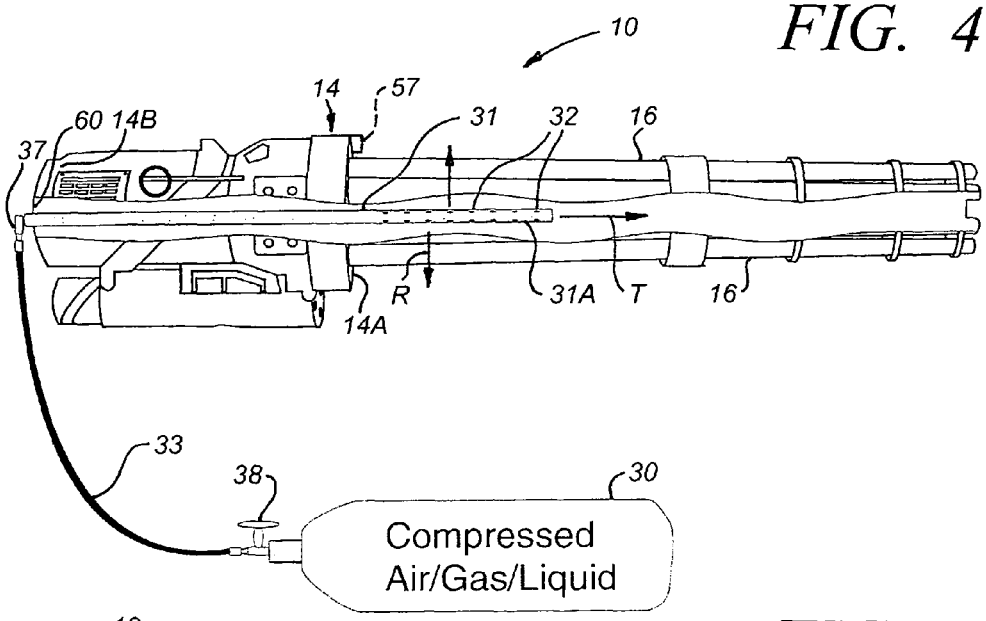
FIG. 4 is a side, partial section view illustrating the Gatling gun of FIGS. 1 to 3 equipped with cooling apparatus in accordance with the invention.

One embodiment of the invention is illustrated in FIG. 4 and includes a hollow conduit 31 with an end 31A that extends intermediate barrels 16 and includes perforations 32 formed therein. End 31A can include one or more perforations, wherein a perforation is an opening formed in end 31A that permits a fluid to move from inside conduit 31, through the opening, and out of conduit 31 into an area intermediate or adjacent at least a pair of barrels 16. When valve 38 is open, compressed (pressurized) fluid travels from tank 30, through hollow hose or conduit 33, through connector 37, through conduit 31, and out through perforations 32. The fluid can comprise air, hydrogen, water, or any other fluid. Any desired apparatus can be utilized to deliver a pressurized fluid into conduit 31.

In FIG. 4, end 31A extends into barrel assembly 15 a distance of less than half the length of each barrel 16. In contrast, in the embodiment of the invention illustrated in FIG. 5, the end 34A of hollow conduit 34 extends nearly the entire length of each barrel 16. In FIG. 6, end 40A of hollow conduit 40 includes hollow cylindrical members with perforations 41 formed therein. Fluid flowing into connector 37 and into conduit 40 exits radially in the manner indicated by arrow U through perforations 41 formed in the cylindrical members. In each of the embodiments illustrated in FIGS. 4 to 6, fluid exits from the respective conduit 31, 34, 40 in a radial direction of travel (perpendicular to the longitudinal axis of the barrel assembly 15) in the manner indicated by arrows R, S, U, respectively. Air can also, if desired, exit a conduit 31 in a longitudinal direction of travel parallel or co-linear to the longitudinal axis of the barrel assembly 15 and the longitudinal axis of conduit 31; or, can exit a conduit in a canted direction of travel intermediate a radial direction of travel and longitudinal direction of travel.

In the presently preferred embodiments of the invention, the longitudinal axis of each conduit 31, 34, 40 is generally co-linear with the longitudinal axis of barrel assembly 15, although this need not be the case. The longitudinal axis of a conduit 31, 34, 40 can be offset from the longitudinal axis of assembly 15 and need not be parallel to the longitudinal axis of assembly 15. Positioning a conduit with its longitudinal axis coincident with the longitudinal axis of barrel assembly 15 is convenient in a 7.62 minigun because an opening 60 exits and extends through the center of the housing assembly 14 and through the center of the rotor assembly housed in the assembly 14. A hollow conduit 31, 34, 40 can—provided the diameter of the hollow conduit is not too great—be readily slid through this opening 60 to the position illustrated in FIGS. 4 to 6. As shown in FIG. 1, opening 60 begins at the outer end 14B (FIG. 4) of the housing assembly 14. As is well known with respect to a 7.62 minigun, housing assembly 14 includes a rotor assembly (not visible).

Figure 5:
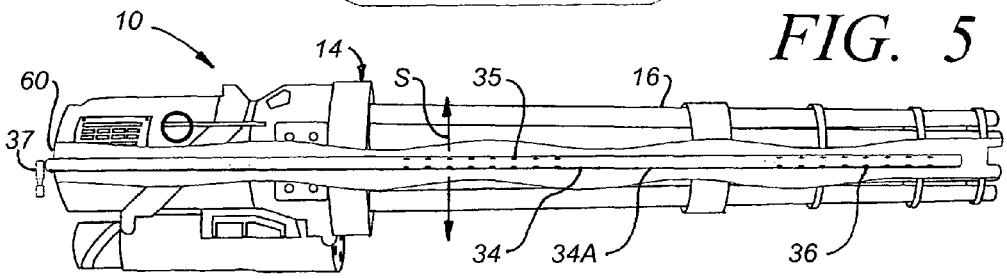
FIG. 5 is a side, partial section view illustrating the Gatling gun of FIGS. 1 to 3 equipped with cooling apparatus in accordance with another embodiment of the invention.
Figure 6:
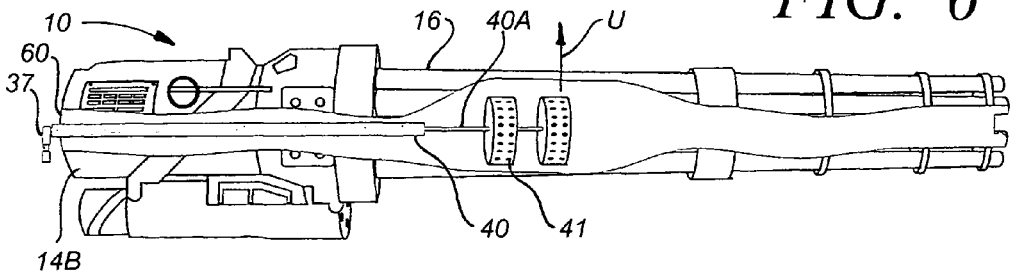
FIG. 6 is a side, partial section view illustrating the Gatling gun of FIGS. 1 to 3 equipped with cooling apparatus in accordance with still another embodiment of the invention; and, FIG. 7 is a block diagram illustrating of the control box utilized in the Gatling gun of FIGS. 1 to 6.

In FIGS. 4 to 6, each conduit 31, 34, 40 extends completely through housing assembly 14. If desired, each conduit 31, 34, 40 need not extend completely through housing assembly 14. Further, if desired, a conduit 31, 34, 40 can be mounted such that it begins at and is secured to end 14A of housing assembly 14 and extends along barrel assembly 15 without extending into opening 60 or into housing assembly 14. A separate tubing or conduit for delivering a cooling fluid into or near a conduit 31, 34, 40 secured to end 14A can be mounted in housing assembly 14. If an open fluid-receiving end of a conduit 31, 34, 40 is adjacent end 14A, a fluid delivery tube carrying cooling fluid to conduit 31, 34, 40 need not be directly connected to conduit 31, 34, 40. The dispensing end of the fluid delivery tube can be spaced apart from the fluid-receiving end of the conduit 31, 34, 40 because pressurized fluid leaving the dispensing end of the fluid delivery tube will readily travel into conduit 31, 34, 40 by moving across the gap between the dispensing end of the fluid delivery tube and the fluid-receiving end of the conduit 31, 34, 40, and, after traversing said gap, traveling into the fluid-receiving end of the conduit 31, 34, 40.

As shown in FIG. 2, the control box 11 is connected to the end of the housing assembly 14. Control box 11 is omitted in FIGS. 5 to 6. If control box 11 were shown, it could be seen that conduit 33 extends intermediate box 11 and the outer end 14B (FIG. 4) of housing assembly 14. In an alternate embodiment of the invention, hollow conduit 31, 34, 40 extends from opening 60 at least partially into control box 11. If a portion of conduit 31, 34, 40 extends into control box 11, that portion of conduit 31, 34, 40 may, or may not, be connected or secured to box 11.

The cooling system of the invention can include a temperature sensor 57 (FIG. 4) to monitor the temperature of the barrel assembly 15 or other portion of gun 10. The temperature sensor 57 can, like a thermometer, include a digital or other readout located at the same site as the thermometer. Preferably, however, a hard wire or wireless signal is transmitted from sensor 57 to a display 50 and/or microprocessor 55 located in the control box 11 or elsewhere on gun 10. The temperature sensor can be mounted at any desired location on gun 10.

Microprocessor 55 comprises a computer that includes, in conventional fashion, a memory 53 and a control including sub-routines 52 that can utilize data stored in memory 53. For example, the computer can receive temperature data from the sensor 57, store the data in memory 53, and utilized a sub-routine to analyze the temperature data and cause the current temperature to be shown on a display 50 and, when the temperature reaches an unacceptably high level, cause the gun 10 to cease firing.

The system can also include a system to mechanically control valve(s) 38 so that an individual utilizing gun 10 need not be concerned with manually operating valve 38 to turn the valve on and off, but can depress a button to cause valve 38 to open, or close.

In the currently preferred embodiment of the invention, a microprocessor 55 is included in control box 11 (FIG. 7) or elsewhere on gun 10. The microprocessor receives and stores in memory 53 signals from sensor 57 and then, when the temperature of the barrel assembly reaches a preselected level, automatically generates a signal that operates valve 38 and causes valve 38 to open to permit fluid to flow from tank 30 to and through a conduit 31, 34, 40. In one embodiment of the invention, a sensor is included on tank 30 to determine the temperature of the fluid in the tank 30 and to transmit this temperature to microprocessor 55 so that microprocessor 55 can factor in the tank 30 temperature and use a sub-routine 52 and data in memory 53 to determine how far to open valve 38. Similarly, microprocessor can factor in the temperature of the barrel assembly 15 and use a sub-routine 52 and data in memory 53 (FIG. 7) to determine whether to open valve 38 completely, or only partially, and, to determine when to close valve 38.

Figure 7:
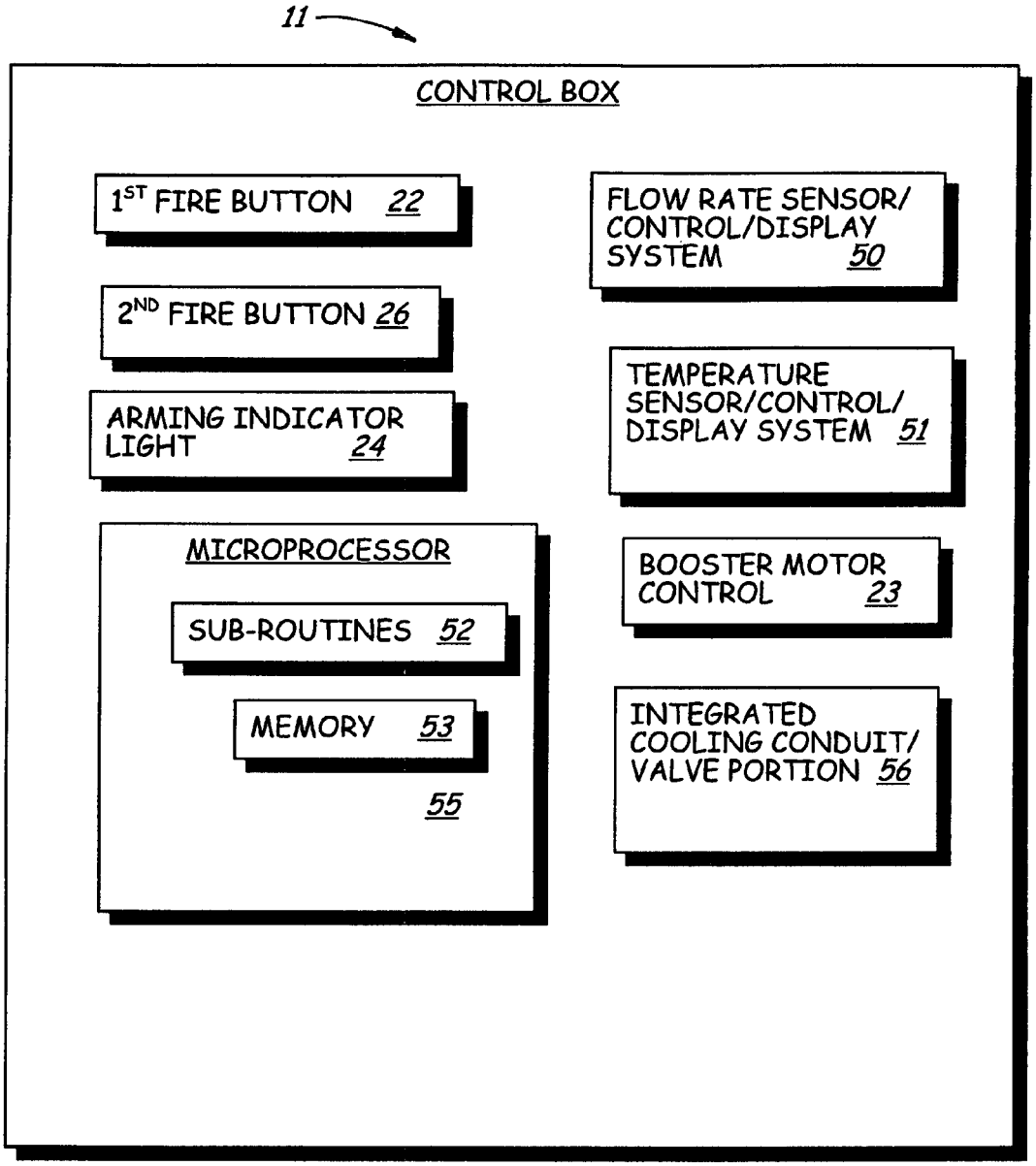

As is depicted in FIG. 7, control box 11 can include a temperature sensor, control or display system 51. The display portion of the system 51 shows the temperature of barrel assembly 15 as detected by sensor 57 and can comprise, by way of example, an LCD display. The sensor 57 portion of the system can, if desired, be directly mounted in box 11, based on the premise that as the barrel assembly warms a concomitant warming will occur in the control box 11. Thermocouples or other temperature sensors are well known in the art. The control portion of the system 51 can comprise a microprocessor 55.

Control box 11 can includes a flow rate sensor/control/display system 50. The display portion of system 50 can include a display that indicates the rate of flow of fluid through valve 38, conduit 33, and/or conduit 31, 34, 40 and can, by way of example, comprise an LCD display. The flow rate sensor can, if desired, be directly mounted in box 11, be located adjacent valve 38, or be located at any desired location. Sensors for measuring the rate of flow of a fluid through a conduit are well known in the art. The control portion of system 50 can comprise a microprocessor 55 that, for example, receives data from the sensor portion of system 50 and causes the current flow rate to be shown on the display portion of the system.

In FIG. 7, the block labeled "INTEGRATED COOLING CONDUIT/VALVE PORTION" 56 confirms that, if desired, a portion of a conduit 31, 34, 40 can be fixedly or removably integrated with control box 11.

In a first retrofit embodiment of the machine gun cooling system of the invention, apparatus is provided including (1) a conduit 31 or 34 or 40, (2) a source 30 of fluid, (3) a conduit connecting the fluid source or tank 30 to conduit 31 or 34 or 40, and (4) a valve(s) 38. The conduit 31, 34, 40 is mounted to extend through opening 60 and intermediate the barrels 16 in a 7.62 minigun in the manner illustrated in FIGS. 4 to 6, and the cooling system is ready to be utilized. Valve 38 is opened when it is desired to direct fluid from source 30 into and out of conduit 31, 34, 40 to cool gun 10.

In a second retrofit embodiment of the invention, the apparatus of the first retrofit embodiment is provided along with a temperature sensor 57. The temperature sensor 57 is installed and the conduit 31, 34, 40 is mounted to extend through opening 60 and intermediate the barrels 16 in a 7.62 minigun in the manner illustrated in FIGS. 4 to 6, and the cooling system is ready for use. The cooling system of the invention can, as would be appreciated by those of skill in the art, be utilized in Gatling guns other than the 7.62 minigun. Fluid from tank 30 is utilized to cool the gun when the temperature measured by sensor 57 rises to a pre-selected level.

In a third retrofit embodiment of the invention, the apparatus of the first retrofit embodiment is provided along with a control box 11. A portion of the conduit 31, 34, 40 is integrated in the control box 11. The conduit 31, 34, 40 is mounted to extend through opening 60 and intermediate the barrels 16 in a 7.62 minigun in the manner illustrated in FIGS. 4 to 6, the control box 11 is secured to the housing assembly 14, and the cooling system is ready for use. Valve 38 is opened when it is desired to cool gun 10.

In a fourth retrofit embodiment of the invention, the apparatus of the third retrofit embodiment of the invention is provided, along with a microprocessor 55 in box 11, a flow rate control/display 50 in box 11, and a temperature sensor/control/display 51 (including temperature sensor 57) in box 11. The conduit 31, 34, 40 is mounted to extend through and along opening 60 and intermediate the barrels 16 in a 7.62 minigun in the manner illustrated in FIGS. 4 to 6, the control box 11 is secured to the housing assembly 14, the sensor 57 is installed, and the cooling system is ready for use. When it is desired to cool gun 10, valve 38 is opened to permit fluid to flow from tank 30 through conduit 31, 34, 40.

As earlier noted, in FIG. 4, cooling fluid is compressed and stored under pressure in tank 30. Alternatively, compressed or uncompressed fluid can be directed into a conduit 31, 34, 40 by a pump, turbine, blower, etc. or any other desired apparatus that will force the fluid through the conduit 31, 34, 40 and out through perforations formed in the end of the conduit. When microprocessor 55 receives signals from sensor 57 indicating that the temperature of the barrel assembly has reached a selected temperature, microprocessor 55 opens valve 38 to permit fluid to flow through conduit 31, 34, 40 to cool assembly 15. The cooling fluid can, prior to it use to cool gun 10, be pre-cooled to a selected temperature.

Having described the presently preferred embodiments and best mode of the invention in such terms as to enable those of skill in the art to understand and practice the invention, I Claim:

1. In combination with a machine gun including a gun housing, and a rotatable barrel assembly mounted on said gun housing and including a plurality of circumferentially mounted barrels, the improvements comprising a cooling system comprising (a) at least one fluid conduit having a perforated end extending (i) intermediate the circumferentially mounted barrels, and (ii) into and through at least a portion of said gun housing;

(b) a fluid distribution system for directing a cooling fluid through said conduit and out said perforated end intermediate the circumferentially mounted barrels;

(c) a control box assembly mounted on said gun housing and operably associated with said fluid distribution system and comprising (i) a control box housing;

(ii) a firing control mounted on said control box housing;

(iii) a control system mounted on said control box housing for determining the temperature of the barrel assembly and, when said temperature reaches a selected level, directing a cooling fluid against the barrel assembly.

* * * * *